United States Patent [19]

Riley, Jr. et al.

[11] Patent Number: 4,647,890

[45] Date of Patent: Mar. 3, 1987

[54] MOLDED FERROMAGNETIC RETURN CIRCUIT FOR A SOLENOID

[75] Inventors: William E. Riley, Jr.; Richard Razgaitis, both of Columbus; Raymond E. Mesloh, Worthington, all of Ohio

[73] Assignee: Battelle Development Corporation, Columbus, Ohio

[21] Appl. No.: 863,743

[22] Filed: May 15, 1986

[51] Int. Cl.[4] ..... H01F 7/00

[52] U.S. Cl. ..... 335/278; 335/281; 29/608

[58] Field of Search ..... 335/255, 260, 278, 281, 335/296; 29/602 R, 606, 608

[56] References Cited

U.S. PATENT DOCUMENTS

| | | | |
|---|---|---|---|
| 3,043,994 | 7/1962 | Anderson et al. | 335/278 X |
| 3,201,729 | 8/1965 | Blanchi et al. | 335/278 X |
| 3,775,841 | 12/1973 | Lathouwers et al. | 29/608 X |

*Primary Examiner*—George Harris

*Attorney, Agent, or Firm*—Benjamin Mieliulis

[57] ABSTRACT

An improved solenoid is disclosed. The improvement consists of injection molding one or more components of the magnetic return circuit of the solenoid, particularly the magnetically permeable can, from a polymer having a filler of soft magnetic material at preferably a 20–63% by volume loading level. The injection molded polymer filled solenoid has higher efficiencies than expected based on the decrease in total metal content.

7 Claims, 4 Drawing Figures

MOLDED FERROMAGNETIC RETURN CIRCUIT FOR A SOLENOID

BACKGROUND OF THE INVENTION

1. Field of the Invention

This invention relates to basic electrical devices; namely, solenoids comprising an electrically energized coil surrounding a plunger. Solenoids convert electrical energy into mechanical energy associated with linear motion. Solenoids can be of the push or pull type.

2. Description of Related Art

Solenoids have long been known in the electrical art. The basic electrical design principle of solenoids is simple and involves assembling an electrically energized coil wound on a spool body and surrounding either a plunger or a fixed core.

The magnetic force owing to the ampere windings of the coil exert an attraction on the plunger. When these ampere windings of the coil are energized, a magnetic force is exerted on the plunger. The plunger, responding to the influence of the coil's magnetic field typically is designed to slide into the axial tubular passage defined by the coil windings and spool body.

It has been known in the prior art to place an iron or steel casing around the coil. The iron or steel casing or can provides an enhanced magnetic return circuit. The mechanical force that the plunger can exert is increased particularly toward the end of the plunger's stroke. An electromagnetic attraction is exerted between the can and the end of the plunger. The can-encased solenoid has been the conventional solenoid in this art for well over forty years.

A need has existed in the art for a solenoid having simplified assembly. If some assembly step could be eliminated, production would be increased with a resulting lower unit cost.

It is an object of the present invention to disclose an improvement over the conventional steel can encased solenoid.

It is an object of the present invention to disclose a solenoid having a metal-filled polymer as the magnetic return circuit. It is a further object to disclose a solenoid with a metal-filled polymer as the magnetic return circuit which can be injection molded.

SUMMARY OF THE INVENTION

Figure 1:
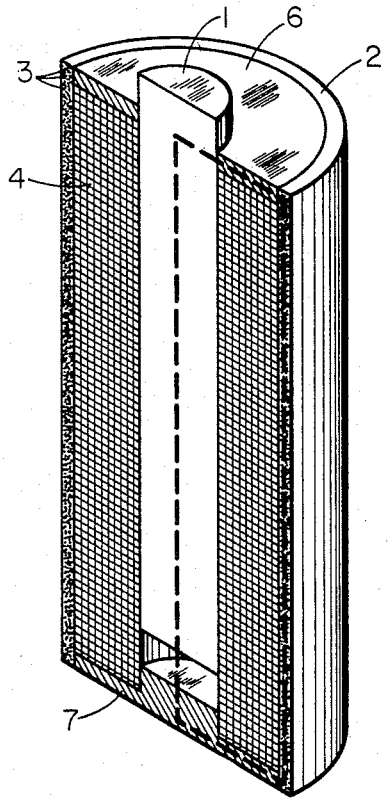
FIG. 1 is a cross-sectional view of a solenoid according to the invention.

The present invention advances the art with the discovery that the magnetic return circuit of a solenoid, typically the iron or steel can, can be replaced by a filled polymeric composition.

Surprisingly, it has been found that the magnetic return circuit of a solenoid can be comprised of a metal-filled polymer in partial or complete replacement of the iron or steel components of the magnetic return circuit comprising the can and one or more field washers. Surprisingly, the magnetic return circuit when formulated from a metal-filled polymer at 40% by volume metal loadings had 84% of the pull efficiency as compared to a similar solenoid having an all metal can. That a 40% filled polymer could yield a solenoid having 84% of the force of a solenoid with an all metal case was unexpected.

DETAILED DESCRIPTION

The present invention discloses an improved solenoid of the type having a magnetic return circuit, a coil wound on a spool body, and a plunger wherein the plunger is movable within a tubular axial passage of the spool body and wherein the magnetic return circuit is provided by a magnetically permeable can encasing the coil. Prior to the invention, convention had dictated that the can and other parts of the magnetic return circuit such as field washers be of punched steel construction. Formation of a metallic can or washer requires a series of steps leading up to a punching operation on a hydraulic punch press, deburring, followed by internal component assembly.

The present invention advances the art by teaching the improvement that a solenoid can be manufactured utilizing a magnetic return circuit consisting of a metal particulate filled polymer encasing the coil. The polymer advantageously contains not more than 63% by volume, and preferably 20% to 63% by volume of the metal filler. Advantageously, the magnetic return circuit can be injection molded.

Surprisingly, at 40% by volume metal filler loading in the molded polymer forming the magnetic return circuit (which is principally the surrounding can) the solenoid has 84% of the pull efficiency of a solenoid utilizing an all metal can. This slight compromise in pull, however, is more than offset in most applications by the tremendous savings gained in manufacture by being able to injection mold the solenoid can. The coil can be inserted into the mold and a can molded around the coil to encase the coil in a metal-filled polymer. The plunger can be preinserted into the coil or inserted into the coil after the molding step which forms the can around the coil.

The magnetic return circuit can be injection molded in a conventional injection mold, for example, using a Battenfield press at a mold temperature of around 250° C. where the polymer is polycarbonate.

The polymer can be selected from any of the known moldable polymers such as, without limitation, polyethylene or other polyalkenes, or polycarbonate, polyepoxides, polyamides such as nylon 6/6, polyesters, polyurethanes, or polystyrenes such as butyl styrenes or ABS. Polyethylene is preferred. Thermoplastic polymers are preferred though filled thermosets such as phenolics can be used in the invention.

The filler selected should be a soft magnetic material. Soft magnetic materials are ferromagnetic metals. High magnetic permeability is desirable in the invention. Useful ferromagnetic metals are: irons, ferrites, ferrospaniels, low carbon steel such as M-14 TM; iron nickel alloys and iron nickel copper alloys such as Permalloy TM, Mumetal TM, Allegheny 4750 TM, Hipernik TM; iron cobalt alloys such as Vanadium Permendur TM; iron nickel cobalt alloys such as Perminvar TM, and iron nickel chromium silicon alloys.

FIG. 1 depicts coil 4 which consists of coil windings wound around a spool body (not shown). Can 2 encases the solenoid coil. Can 2 consists of molded polymer having metal filler 3. Can 2 is molded so as to encase coil 4 and top field washers 6 and pole field washer 7 both comprised of steel. The magnetic return circuit path is shown by dotted lines.

Figure 2:
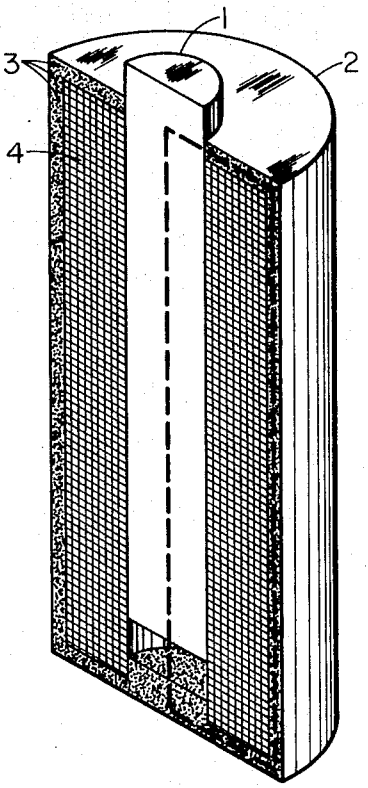
FIG. 2 is a cross-sectional view of a solenoid according to the invention wherein the entire magnetic return circuit is replaced with an injection-molded filled polymer.

Looking now at the solenoid of FIG. 2, coil 4 consists of coil windings wound around a spool body (not shown) and defines a tubular axial passage into which plunger 1 is inserted. Encasing the coil is can 2 comprised of molded polymer having metal filler 3.

Figure 3:
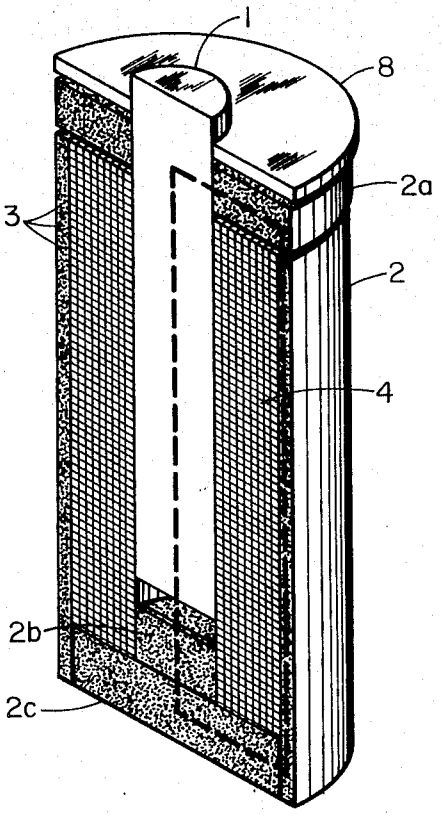
FIG. 3 is a cross-sectional view of a solenoid according to the invention wherein the injection-filled polymeric pieces replacing the magnetic return circuit are comprised of multiple assembled pieces.

FIG. 3 depicts a best mode of an assembled version of the invention. The solenoid of FIG. 2 shows can 2 comprised in addition of multiple components—pole washer 2*c*, pole piece 2*b*, and field washer 2*a* rather than as a unitary piece. Retaining washer 8 and can components 2 and 2*a* for clarity are depicted spaced apart, but in actual production would be assembled in abutting contact. A nonconductive retaining washer 8 is also depicted. In production, the unitary can of FIG. 2 is expected to be preferred.

The magnetic return circuit includes the field can, field washers, and pole washers. By being able to replace these parts with a filled polymeric composition, increased production becomes possible surprisingly without significant sacrifice in pull performance.

A solenoid with a magnetic return circuit comprised of a 40% by volume metal filled polymer surprisingly has 84% of the pull efficiency of a solenoid with an all steel magnetic return circuit. A solenoid with a magnetic return circuit comprised of a 35% by volume metal filler polymer has 82% of the pull efficiency of a solenoid with an all steel magnetic return circuit.

Above a 63% by volume metal fill level in the polymer the pull values start to approach a linear slope. Additionally, above 63% by volume filler, brittleness becomes a problem as well as poor surface appearance, along with lowered tensile and flexural strengths.

Figure 4:
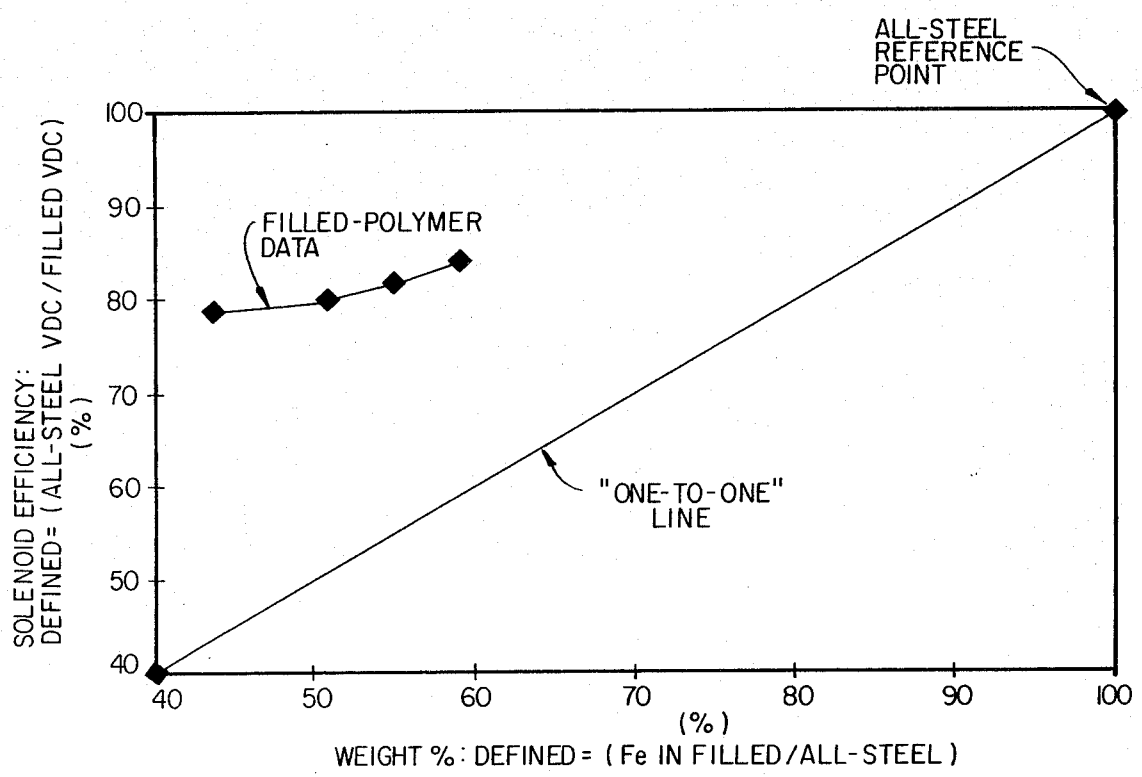
FIG. 4 is a graph comparing pull-in value efficiencies of solenoids according to the invention vs. the percent by weight of metal filler.

FIG. 4 compares the efficiency in terms of the ratio of pull in volts of a filled-polymer solenoid in reference to a one-to-one line for an all steel solenoid. The graph clearly indicates the surprising result that solenoid efficiency does not fall off linearly as the percent by weight of iron filling is decreased. Efficiencies of the filled polymer solenoids are surprisingly higher than would be expected.

That the magnetic return circuit of a solenoid can be injection molded of a metal filled polymeric composition without substantial loss in pull, as compared to a solenoid with an all steel magnetic return circuit, was completely unexpected from the teachings of the prior art.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes can be made by those skilled in the art without departing from the spirit and scope of the invention.

EXAMPLE

A conventional solenoid with a steel can as part of the magnetic return circuit was compared to dimensionally similar solenoid using a molded iron-filled polymer for the can. The mold part was made to the same dimensions as the steel can and pole washer it replaced.

A pull-in voltage test was used to characterize the solenoids by determining the DC pull-in volts at a stroke of 7 mm against a load of 135 grams.

| | Pull in Volts | Weight of Metal | Fill by Vol. | Relative Strength of Solenoid Field |
|---|---|---|---|---|
| All steel solenoid | 26.8 | 60.2 g | — | 100% |
| Filled polymer solenoid | 32.0 | 35.3 g | 40% | 84% |
| Filled polymer solenoid | 32.85 | 33.1 g | 35% | 82% |
| Filled polymer solenoid | 33.6 | 30.9 g | 30% | 80% |
| Filled polymer solenoid | 34.1 | 26.6 g | 20% | 79% |

Surprisingly the filled polymer solenoid filled at 40% by volume, despite having 41% less metal is able to exert 84% of the pull of an all-steel solenoid. The filled polymer solenoid filled at 35% by volume, has 45% less metal in the magnetic return circuit, but is able to exert 82% of the pull of an all-steel solenoid.

What we claim is:

1. An improved solenoid of the type having a coil on a spool body, a plunger, the plunger being movable within a tubular axial passage of the spool body and a magnetic return circuit, the magnetic return circuit being substantially provided by magnetic return circuit components consisting of a magnetically permeable can and one or more magnetically permeable field washers encasing the coil, wherein the improvement comprises a magnetic return circuit component consisting of a molded ferromagnetic particulate filled polymer, the polymer containing not more than 63% by volume of said ferromagnetic metal.

2. The improved solenoid according to claim 1 wherein the magnetic return circuit component consisting of a molded ferromagnetic particulate filled polymer is the magnetically permeable can.

3. The improved solenoid according to claim 1 wherein the magnetic return circuit consists of a molded ferromagnetic particulate filled polymer.

4. The improved solenoid according to claim 1 wherein the polymer is selected from polyalkene, polyamide, polycarbonate, polystyrene, or polyepoxide.

5. The improved solenoid according to claim 1 wherein the ferromagnetic particulate is selected from iron, ferrites, ferrospaniel, carbon steel, iron nickel alloy, iron nickel copper alloy, iron cobalt alloy, iron nickel cobalt alloy or iron nickel chromium silicon alloy.

6. The improved solenoid according to claim 1 wherein the polymer contains from 20 to 63% by volume of said ferromagnetic metal.

7. An improved method for manufacturing a solenoid of the type wherein a can-encased electrically energized coil surrounds a movable plunger comprising:

winding a coil onto a spool body having a tubular axial passage, inserting the wound coil and spool body into a mold, injection molding a can encasing the coil from a blend of a polymer and of a ferromagnetic particulate metal filler at a concentration of 20% to 63% metal by volume, and inserting a plunger into the tubular axial passage of the spool body.

* * * * *